US006611083B2

(12) United States Patent
LaBarge et al.

(10) Patent No.: US 6,611,083 B2
(45) Date of Patent: Aug. 26, 2003

(54) TORCH JET SPARK PLUG ELECTRODE

(75) Inventors: William J. LaBarge, Bay City, MI (US); Conrad H. Anderson, Davison, MI (US); Kaius K. Polikarpus, Grand Blanc, MI (US); Greg Rasmussen, Grand Blanc, MI (US)

(73) Assignee: Savage Enterprises, Inc., Edina, MN (US)

( * ) Notice: Subject to any disclaimer, the term of this patent is extended or adjusted under 35 U.S.C. 154(b) by 401 days.

(21) Appl. No.: 09/738,713

(22) Filed: Dec. 15, 2000

(65) Prior Publication Data

US 2002/0074918 A1 Jun. 20, 2002

(51) Int. Cl.[7] ..... H01T 13/20
(52) U.S. Cl. ..... 313/140; 313/141; 123/169 EL
(58) Field of Search ..... 324/140, 141, 324/118, 142, 135, 311; 123/266–268, 169 EL–169 PA

(56) References Cited

U.S. PATENT DOCUMENTS

| | | | | |
|---|---|---|---|---|
| 3,921,605 A | | 11/1975 | Wyczalek | |
| 4,059,079 A | | 11/1977 | Kasima et al. | |
| 4,924,829 A | | 5/1990 | Cheng et al. | |
| 4,930,473 A | * | 6/1990 | Dietrich | 123/266 |
| 4,987,868 A | | 1/1991 | Richardson | |
| 5,172,025 A | * | 12/1992 | Oshima et al. | 313/136 |
| 5,245,963 A | | 9/1993 | Sabol et al. | |
| 5,405,280 A | | 4/1995 | Polikarpus et al. | |
| 5,421,300 A | | 6/1995 | Durling et al. | |
| 5,461,275 A | * | 10/1995 | Oshima | 313/141 |
| 5,894,186 A | | 4/1999 | Matsutani et al. | |
| 6,213,085 B1 | * | 4/2001 | Durling et al. | 123/266 |
| 6,359,377 B1 | * | 3/2002 | Durling | 313/118 |

* cited by examiner

*Primary Examiner*—Jay Patidar
(74) *Attorney, Agent, or Firm*—Moore, Hansen & Sumner

(57) ABSTRACT

The torch jet spark plug comprises a shell with an insulator body concentrically disposed within at least a portion of the shell. A pre-chamber is concentrically disposed within at least a portion of the shell and at least a portion of the insulator body, the pre-chamber having an orifice disposed at a first end of the pre-chamber and at an insulator body first end. On at least a portion of a pre-chamber internal surface is an inner electrode comprising up to about 75 vol. % of a bonding agent, about 20 vol. % or greater of a catalytically active material, and about 5 vol. % or greater of a transition metal material. At least partially disposed within a second end of the insulator body, opposite the insulator body first end is an upper terminal. Finally, an upper electrode is disposed within the insulator body, between the inner electrode and the upper terminal, and in a spaced relation to the inner electrode.

22 Claims, 1 Drawing Sheet

TORCH JET SPARK PLUG ELECTRODE

TECHNICAL FIELD

The present invention relates to spark plugs. More particularly, the present invention relates to torch jet spark plugs.

BACKGROUND OF THE INVENTION

Conventional spark plugs have primarily two functions in an internal combustion engine. The first is to efficiently ignite the fuel/air mixture and the second is to remove the heat out of the combustion chamber. A sufficient amount of voltage must be supplied by the ignition system to cause a spark to jump across the spark plug gap. Additionally, the temperature of the spark plug's firing end must be kept low enough to prevent pre-ignition, but high enough to prevent fouling of the spark plug.

As disclosed in U.S. Pat. No. 5,421,300 to Durling, et al., a torch jet spark plug is configured to ignite an air/fuel mixture within a combustion pre-chamber formed integrally within the body of the spark plug, such that a jet of burning gases emanates from the pre-chamber and projects into the main combustion chamber of the engine, in order to enhance burning within the main chamber. The torch jet has several electrodes: a first inner electrode (projecting into the pre-chamber); a second inner electrode (located on the internal surface of the pre-chamber forming a gap with the first inner electrode); an outer electrode (formed integral to the second inner electrode); and a ground electrode (formed adjacent to the outer electrode to define an outer spark gap). The inner spark gap ignites the air/fuel mixture that is introduced into the pre-chamber during the engine's compression stroke. This results in a jet of unburned air/fuel being ejected from an opening at the end of the pre-chamber when the spark plug is fired. The jet passes near the outer spark gap and is ignited by the flame kernel from that gap. The now burning jet carries the flame rapidly and deeply into the main combustion chamber.

The internal electrodes of the torch jet spark plug ignite the air/fuel mixture within the pre-chamber. Conventional materials for spark plug electrodes include a copper core center electrode with platinum tipped center and side electrodes. Since the torch jet spark plug involves the burning of gases within the spark plug pre-chamber, the electrodes are exposed to extreme service conditions (mechanical, chemical, electrical, and thermal conditions) causing erosion and electrode burning.

What is needed in the art is an electrode for spark plugs that is electrically and thermally conductive, corrosion resistant, and high temperature resistant.

SUMMARY OF THE INVENTION

The deficiencies of the above-discussed prior art are overcome or alleviated by the torch jet spark plug and electrode composition. The torch jet spark plug electrode composition comprises, based upon the volume of the composition: up to about 75 vol. % of a bonding agent, about 20 vol. % or greater of a catalytically active material, and about 5 vol. % or greater of a transition metal material.

The torch jet spark plug comprises a shell with an insulator body concentrically disposed within at least a portion of the shell. A pre-chamber is concentrically disposed within at least a portion of the shell and at least a portion of the insulator body, the pre-chamber having an orifice disposed at a first end of the pre-chamber and at an insulator body first end. On at least a portion of a pre-chamber internal surface is an inner electrode comprising up to about 75 vol. % of a bonding agent, about 20 vol. % or greater of a catalytically active material, and about 5 vol. % or greater of a transition metal material. At least partially disposed within a second end of the insulator body, opposite the insulator body first end, is an upper terminal. Finally, an upper electrode is disposed within the insulator body, between the inner electrode and the upper terminal, and in a spaced relation to the inner electrode.

The above discussed and other features and advantages of torch jet spark plug electrode will be appreciated and understood by those skilled in the art from the following detailed description and drawings.

BRIEF DESCRIPTION OF THE DRAWINGS

The torch jet spark plug electrode will now be described, by way of example only, with reference to the accompanying drawings, which are meant to be exemplary, not limiting, and wherein like elements are numbered alike in several figures.

DETAILED DESCRIPTION OF INVENTION

Figure 1:
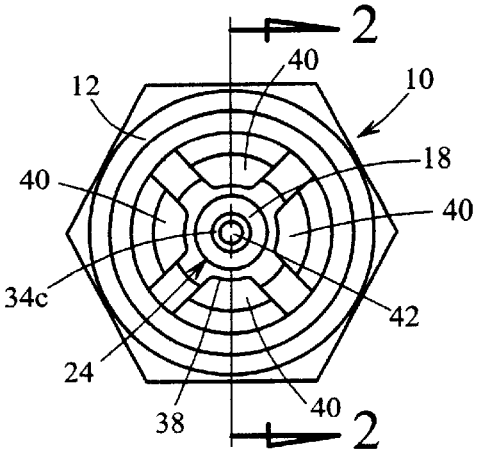
FIG. 1 is an end view of an exemplary torch jet spark plug.
Figure 2:
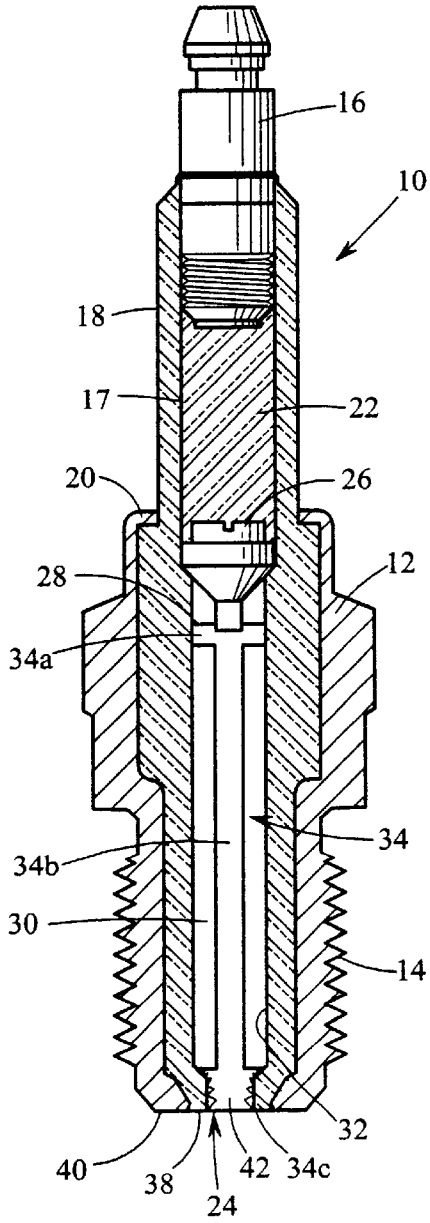
FIG. 2 is a cross-sectional view of an exemplary torch jet spark plug along lines 2—2.

The torch jet spark plug electrode can be utilized with a torch-jet assisted spark ignition system for an internal combustion engine. An exemplary torch jet spark plug 10 is illustrated in FIGS. 1 and 2. As with spark plugs typically used with internal combustion engines, the spark plug 10 includes a shell 12, generally formed from ferrous material such as steel. External threads 14 are formed at one end of the shell 12 for the purpose of installing the spark plug 10 into a threaded hole in a wall of a combustion chamber within an internal combustion engine (not shown). An insulator body 18, generally formed from a ceramic material, such as alumina ($Al_2O_3$) and the like, is secured within the shell 12 in any suitable manner, such as by crimping. A gasket 20 of a suitable temperature resistant material, such as copper, steel, and the like can be provided between the shell 12 and the insulator body 18 to create a gas tight seal therebetween. The insulator body 18 projects through the end of the shell 12 opposite the threads 14. The portion of the body 18 which projects from the shell 12 has a passage 17 which receives an upper terminal 16, by which an electric current can be supplied to the spark plug 10. Located at the end of the spark plug 10 opposite the upper terminal 16 is a ground terminal 40.

As illustrated in FIG. 2, the ground terminal 40 can be composed of four prongs, though fewer or more prongs could foreseeably be utilized. Each prong extends radially inward toward the perimeter of the hollow electrode 24, such that the outer spark gap 38 is radially oriented in a manner somewhat similar to the inner spark gap 28. An advantage of this structure is the availability of separate locations across which an electric spark can jump from the hollow electrode 24 to the ground terminal 40. As such, the electric spark will jump to the prong offering the path of least resistance, keeping the sparking voltage at a minimum level and thus improving engine performance, particularly during extended engine operation which could cause electrode erosion, leading to increased sparking voltage requirements.

An electric current introduced at the upper terminal 16 is conducted to the ground terminal 40 through a resistor material and seal 22 disposed in the passage 17 in the insulator body 18. The spark plug 10 includes a pre-chamber 30 and, in series, the resistor material and seal 22, an inner electrode 34 which is disposed on the internal surface 32 of the pre-chamber 30, and an outer, hollow electrode 24 formed on the walls of an orifice 42 in the pre-chamber 30.

The resistor material and seal 22 are preferably a glass seal resistor material of a type known in the art, which provides electromagnetic interference suppression while also hermetically sealing the passage 17 from the pre-chamber 30. The pre-chamber 30 is preferably elongated, extending along the longitudinal axis of at least a portion of the insulator body 18, such that the upper electrode 26 projects into an upper end of the pre-chamber 30 while the orifice 42 is disposed at a lower end. The orifice 42 is located about and offset from the longitudinal axis of the insulator body 18 so as to maintain the symmetry of the insulator body 18. The orifice 42 serves to vent the pre-chamber 30 to the main combustion chamber (not shown) of an engine in which the spark plug 10 is installed. The inner electrode 34 includes an upper band 34*a* that circumscribes the upper electrode 26 to form a radial inner spark gap 28, a lower band 34*c* located in the orifice 42, and a metal stripe 34*b* which interconnects the upper and lower bands 34*a* and 34*c*.

Preferably, the hollow electrode 24 is not formed as a metal wire which projects through the lower wall of the pre-chamber 30, but instead is formed by the lower band 34*c* of the inner electrode 34 so as to be integral with the orifice 42 of the pre-chamber 30. Accordingly, the hollow electrode 24 serves two distinct functions. First, the hollow electrode 24 acts as an extension of the inner electrode 34 to form one electrode of the outer spark gap 38. Secondly, the hollow electrode 24 defines the orifice 42 necessary for the intake of the air/fuel mixture during the compression stroke as well as the expulsion of the combustion gases upon ignition of the air/fuel mixture within the pre-chamber 30.

The orifice 42 is offset from the longitudinal axis of the insulator body 18 and the outer spark gap 38 formed between the outer electrode 24 and the ground terminal 40. As such, an electric spark generated at the outer spark gap 38 does not occur within the flow of combustion gases exiting from the pre-chamber 30. This feature is useful since it has been found that under some conditions, the jet can be strong enough to extinguish the flame kernel at the outer spark gap 38, and therefore cause a misfire. Positioning the outer spark gap 38 near the jet orifice 42, but out of its direct path, reduces the tendency for misfire caused by a powerful jet.

The volume of the pre-chamber 30 and the area of the orifice 42 can be selected to provide the desired characteristics for a particular engine and effect that is of interest. For a given pre-chamber volume, a relatively small orifice area restricts the exit of gasses from the pre-chamber 30 causing higher pre-chamber pressures and higher velocity jets when the plug 10 is fired, while a relatively large orifice area results in softer, lower velocity jets. Excessively small orifices 42 restrict filling of the pre-chamber 30 during the engine compression stroke, especially at high engine speeds. Larger pre-chamber volumes produce longer duration jets, but may be difficult to package within a spark plug body. In addition, large pre-chamber volumes introduce additional surface area to the combustion chamber, which is undesirable from the standpoint of heat loss and exhaust emissions. There is no single preferred pre-chamber volume and orifice area combination for all engines, and persons skilled in the art will recognize the advantage of various combinations.

Upon charging the pre-chamber 30 with a suitable air/fuel mixture from an engine's main combustion chamber during a compression stroke, an electric current supplied to the spark plug 10 via the upper terminal 16 will generate an electric spark at the inner spark gap 28, which will ignite the air/fuel mixture within the pre-chamber 30. Thereafter, the electric current will be conducted through the inner electrode 34 to the outer electrode 24, where a second spark will be generated at the outer spark gap 38 to ignite the air/fuel mixture within the main combustion chamber. Though combustion proceeds relatively simultaneously in both the pre-chamber 30 and the main chamber, the small relative volume of the pre-chamber 30 results in a high pressure being developed within the pre-chamber 30 while the pressure within the main combustion chamber is still relatively low. As a result, a jet which initially includes an unburned portion of the pre-chamber's air/fuel mixture will be expelled from the pre-chamber 30, become ignited by the external flame kernel of the outer spark gap 38, and then travel far into the main chamber, thereby significantly increasing the combustion rate within the main chamber.

Since the pre-chamber mixture ignites and spreads the flame to the air/fuel mixture in the main combustion chamber, a robust ignition event is achieved in the main combustion chamber using less electrical energy for the spark than would be required otherwise.

Spark plugs fail when their discharge voltages exceed about 25,000 volts. By reducing the discharge voltage, there is a reduction in the exposure of the electrodes to erosion and an increase in the life expectancy of the spark plug. Generally, electrodes are formed of a catalytically-active, conductive material, although non-catalytic metals may also be employed where catalytic activity is not required. With the use of catalytically-active materials, pre-combustion chemical reactions are promoted during engine compression which enhance the ignitability of the air/fuel mixture within the pre-chamber 30. The preferred catalytically active material is a metal component, preferably capable of being electrically and thermally conductive, and includes, but is not limited to, platinum, palladium, osmium, rhodium, iridium, gold, ruthenium, and the like, as well as oxides, alloys, and combinations comprising at least one of the foregoing metals. The metal is preferred to be present at a volume percent (vol. %) of the electrode composition of about 20 vol. % or greater, with about 20 vol. % to 90 vol. % preferred, and with about 40 vol. % to about 70 vol. % more preferred.

The non-catalytically active material (e.g., bonding agent) of the electrode composition is a material that is preferably compatible with the material of the spark plug body. This material can either be the same material as the insulator body, or can be a material that will help to bond or anchor the electrode to the insulator body. This compatible component can include, but is not limited to, magnesium-aluminum oxide, aluminum oxide, aluminum phosphate, as well as combinations comprising at least one of the foregoing components. Additionally there may be about 20 wt % or less glass "frit", consisting of about 50% silica with the remaining about 50% comprising the oxides of aluminum, yttrium, neodymium, or lanthanum, as well as combinations comprising at least one of the foregoing. Preferably, the bonding agent is present at a vol. % of the electrode composition of up to about 75 vol. %, with about 5 vol. % to 75 vol. % preferred, and with about 10 vol. % to about 55 vol. % more preferred.

A variety of techniques can be used to apply the electrode to the spark plug including sputtering, chemical vapor deposition, screen printing, spraying, dipping, painting, and stenciling, among others. The electrodes are disposed typically up to about 10 to about 1,000 microns or so in thickness, with a thickness of about 20 microns to about 50 microns typically preferred. In one embodiment, the inner electrode 34 is formed by depositing a metal paste on the internal surface 32 of the pre-chamber 30 while the insulator body 18 is in a "green" state, prior to firing. During firing, the carrier component of the metal paste is dissipated, and the metal component wets and adheres to the internal surface 32 of the pre-chamber 30 to form a metal layer having a thickness of preferably about 10 microns to about 30 microns. This process creates a conventional electrode, but regular use of these spark plugs subjects the electrodes to erosion from the discharge voltage of the spark plug.

In reducing the discharge voltage, erosion of the spark plug electrode is also reduced. Discharge voltage is reduced by reducing the electric field strength of the electrode. Since rare earth element or transition metal additives have a tendency to reduce electric field strengths, the addition of the transition metal compound to the conventional inner electrode will aid in the protection of the electrode. The materials to be used can include, but are not limited to, transition metals, such as yttrium, scandium, alkaline earths, such as barium, cesium, and the like, rare earth elements, such as hafnium, cerium, and neodymium, and the like, as well as oxides, alloys, and combinations comprising at least one of the foregoing materials. Preferably, the transition metal, yttria, is used at a volume percent of the electrode composition (comprising the metal, transition metal, and compatible component) of about 5 vol. % or greater, with about 5 vol. % to about 30 vol. % preferred, and about 5 vol. % to about 20 vol. % more preferred.

Since the discharge voltage is important to the survival of the electrode, the addition of the rare earth element/transition metal, creates a spark plug having a discharge voltage of about 20,000 volts or less, with about 19,000 volts or less preferred and about 17,000 volts or less especially preferred. In contrast, a conventional torch jet spark plug generally has a stable discharge voltage of about 23,000 volts.

Specific examples of electrode compositions include: (1) 80 weight percent (wt %) platinum, 17 wt % aluminum oxide and 3.0 wt % yttrium oxide; (2) 80 wt % platinum, 17 wt % aluminum oxide and 2.4 wt % yttrium oxide and 0.6 wt % barium oxide; (3) SCFA (high surface area alumina) aluminum oxide was impregnated with 12% yttrium oxide from deposition and calcinations of yttrium 2-ethylhexanoate; (4) 80 wt % platinum, 17 wt % aluminum oxide, 2.4 wt % hafnium oxide and 0.6 wt % barium oxide; and (5) 80 wt % platinum, 17 wt % aluminum oxide, and 3.0 wt % cerium oxide.

A method for making a torch jet spark plug with this electrode composition is also contemplated. This method comprises mixing the metal component (such as platinum), the compatible component (such as alumina), and the rare earth element/transition metal additive (such as yttria). The electrode is formed when the mixture that is created is deposited on the internal surface of the pre-chamber prior to firing. The insulator body is then fired creating the electrode within the spark plug.

The addition of the rare earth element/transition metal additives to the composition of the electrode serves to reduce the discharge voltage of the spark plug (e.g., to less than about 20,000 volts). In reducing the discharge voltage, there is less erosion of the electrode and the life expectancy of the spark plug is increased. Additionally, the higher the voltage requirement, the more chance for a delayed spark or no spark at all. A conventional spark plug sparks in a range of 10° to 35° ATDC (after top dead center) and may not spark at all 2% or more of the time. A firing at 10° ATDC produces about 1150 kilopascals (kPa) of power, while a firing at 35° ATDC produces only about 950 kPa, making the average power produced about 1050 kPa. A torch jet with a platinum/alumina electrode sparks at about 8° to about 15° ATDC with no measured non-sparking events. The power produced is about 1150 kPa for all firing events. Thus, the torch jet realizes a net power increase of about 100 kPa over a conventional spark plug. Essentially, the platinum/alumina/yttria torch jet sparks easier. Additionally, the durability, as defined by consistent about 8° to about 15° ATDC sparking with no non sparking events, is increased by 30% to 50%.

While preferred embodiments have been shown and described, various modifications and substitutions may be made thereto without departing from the spirit and scope of the invention. Accordingly, it is to be understood that the apparatus and method have been described by way of illustration only, and such illustrations and embodiments as have been disclosed herein are not to be construed as limiting to the claims.

What is claimed is:

1. A torch jet spark plug electrode composition, comprising, based upon the volume of the composition:

up to about 75 vol. % of a bonding agent;

about 20 vol. % or greater of a catalytically active material; and about 5 vol. % or greater of a transition metal material.

2. The torch jet spark plug electrode composition of claim 1, wherein the bonding agent is alumina.

3. The torch jet spark plug electrode composition of claim 1, wherein the bonding agent is the same material as an insulator body of the torch jet spark plug.

4. The torch jet spark plug electrode composition of claim 1, wherein the catalytically active material is selected from the group consisting of platinum, palladium, osmium, rhodium, iridium, gold, ruthenium, and oxides, alloys, and combinations comprising at least one of the foregoing materials.

5. The torch jet spark plug electrode composition of claim 4, wherein the catalytically active material is platinum.

6. The torch jet spark plug electrode composition of claim 1, wherein the transition metal material is selected from the group consisting of yttrium, scandium, barium, cesium, hafnium, cerium, neodymium, and oxides, alloys, and combinations comprising at least one of the foregoing material.

7. The torch jet spark plug electrode composition of claim 6, wherein the transition metal material is yttria.

8. The torch jet spark plug electrode composition of claim 1, further comprising about 20 vol. % to about 90 vol. % of the catalytically active material.

9. The torch jet spark plug electrode composition of claim 1, further comprising about 5 vol. % to about 30 vol. % of the transition metal material.

10. The torch jet spark plug electrode composition of claim 9, further comprising about 5 vol. % to about 20 vol. % of the transition metal material.

11. A torch jet spark plug, comprising:

a shell;

an insulator body concentrically disposed within at least a portion of the shell;

a pre-chamber concentrically disposed within at least a portion of the shell and at least a portion of the insulator body, the pre-chamber having an orifice disposed at a first end of the pre-chamber and at an insulator body first end;

an inner electrode disposed on at least a portion of a pre-chamber internal surface, the inner electrode comprising up to about 75 vol. % of a bonding agent, about 20 vol. % or greater of a catalytically active material, and about 5 vol. % or greater of a transition metal material;

an upper terminal at least partially concentrically disposed within a second end of the insulator body, opposite the insulator body first end; and an upper electrode disposed within the insulator body, between the inner electrode and the upper terminal, and in a spaced relation to the inner electrode.

12. The torch jet spark plug of claim 11, wherein the spark plug has a discharge voltage of about 21,000 volts or less.

13. The torch jet spark plug of claim 11, wherein the discharge voltage is about 18,000 volts or less.

14. The torch jet spark plug of claim 11, wherein the discharge voltage is about 15,000 volts or less.

15. The torch jet spark plug of claim 11, wherein the bonding agent is alumina.

16. The torch jet spark plug of claim 11, wherein the bonding agent is the same material as the insulator body.

17. The torch jet spark plug of claim 11, wherein the catalytically active material is selected from the group consisting of platinum, palladium, osmium, rhodium, iridium, gold, ruthenium, and oxides, alloys, and combinations comprising at least one of the foregoing materials.

18. The torch jet spark plug of claim 17, wherein the catalytically active material component is platinum.

19. The torch jet spark plug of claim 11, wherein the transition metal material selected from the group consisting of yttrium, scandium, barium, cesium, hafnium, cerium, neodymium, and oxides, alloys, and combinations comprising at least one of the foregoing materials.

20. The torch jet spark plug of claim 19, wherein the transition metal material is yttria.

21. The torch jet spark plug of claim 11, further comprising about 5 vol. % to about 30 vol. % of the transition metal material.

22. The torch jet spark plug of claim 21, further comprising about 5 vol. % to about 20 vol. % of the transition metal material.

* * * * *